US008882973B2

(12) United States Patent
Williamson et al.

(10) Patent No.: US 8,882,973 B2
(45) Date of Patent: Nov. 11, 2014

(54) CATHODE POWER DISTRIBUTION SYSTEM AND METHOD OF USING THE SAME FOR POWER DISTRIBUTION

(75) Inventors: Mark A. Williamson, Naperville, IL (US); Stanley G. Wiedmeyer, Glen Ellyn, IL (US); Eugene R. Koehl, Joliet, IL (US); James L. Bailey, Hinsdale, IL (US); James L. Willit, Batavia, IL (US); Laurel A. Barnes, Chicago, IL (US); Robert J. Blaskovitz, Lockport, IL (US)

(73) Assignee: GE-Hitachi Nuclear Energy Americas LLC, Wilmington, NC (US)

( * ) Notice: Subject to any disclaimer, the term of this patent is extended or adjusted under 35 U.S.C. 154(b) by 426 days.

(21) Appl. No.: 13/335,121

(22) Filed: Dec. 22, 2011

(65) Prior Publication Data

US 2013/0161198 A1 Jun. 27, 2013

(51) Int. Cl.

| | |
|---|---|
| ***C25B 9/00*** | (2006.01) |
| ***C25B 11/00*** | (2006.01) |
| ***C25D 17/00*** | (2006.01) |
| ***C25C 7/02*** | (2006.01) |
| ***C25C 3/00*** | (2006.01) |

(52) U.S. Cl.

USPC ..... 204/270; 204/280; 204/246; 204/277; 204/278.5

(58) Field of Classification Search

USPC ..... 204/297.01, 186.01, 267, 275.1, 277, 204/278.5, 232, 286.1; 205/47

See application file for complete search history.

(56) References Cited

U.S. PATENT DOCUMENTS

| | | | |
|---|---|---|---|
| 422,139 | A | 2/1890 | Maxon |
| 2,089,738 | A | 8/1935 | Elmer |
| 2,194,444 | A | 3/1940 | Hulse et al. |
| 2,800,219 | A | 7/1957 | Carroll |
| 2,913,380 | A | 11/1959 | Gullett |
| 3,562,131 | A | 2/1971 | Jasberg |
| 3,645,708 | A | 2/1972 | Grady |

(Continued)

FOREIGN PATENT DOCUMENTS

| | | |
|---|---|---|
| AU | 622994 | 4/1992 |
| CA | 1 142 123 | 3/1983 |

(Continued)

OTHER PUBLICATIONS

Jeong, et al., "Electrolytic production of metallic Uranium from $U_3O_8$ in a 20-kg batch scale reactor", Journal of Radioanalytical and Nuclear Chemistry, vol. 268, No. 2, pp. 349-356 (2006).

(Continued)

*Primary Examiner* — Luan Van

*Assistant Examiner* — Alexander W Keeling

(74) *Attorney, Agent, or Firm* — Harness, Dickey & Pierce, P.L.C.

(57) ABSTRACT

Embodiments include a cathode power distribution system and/or method of using the same for power distribution. The cathode power distribution system includes a plurality of cathode assemblies. Each cathode assembly of the plurality of cathode assemblies includes a plurality of cathode rods. The system also includes a plurality of bus bars configured to distribute current to each of the plurality of cathode assemblies. The plurality of bus bars include a first bus bar configured to distribute the current to first ends of the plurality of cathode assemblies and a second bus bar configured to distribute the current to second ends of the plurality of cathode assemblies.

15 Claims, 3 Drawing Sheets

(56) References Cited

U.S. PATENT DOCUMENTS

| | | | | |
|---|---|---|---|---|
| 3,697,404 | A | 10/1972 | Paige | |
| 3,972,794 | A | 8/1976 | Lamm | |
| 4,013,329 | A | 3/1977 | Hugin | |
| 4,023,673 | A | 5/1977 | Hansen | |
| 4,039,403 | A | 8/1977 | Astley et al. | |
| 4,073,703 | A | 2/1978 | Kinosz | |
| 4,148,392 | A | 4/1979 | Larson et al. | |
| 4,203,531 | A | 5/1980 | Reichel et al. | |
| 4,326,937 | A | 4/1982 | Neumeier et al. | |
| 4,437,968 | A | 3/1984 | Elliott, Jr. | |
| 4,492,621 | A | 1/1985 | Stubb | |
| 4,668,353 | A | 5/1987 | Smith et al. | |
| 4,851,098 | A | 7/1989 | Kimura et al. | |
| 4,863,580 | A | 9/1989 | Epner | |
| 4,880,506 | A | 11/1989 | Ackerman et al. | |
| 4,946,026 | A | 8/1990 | Rickman | |
| 5,015,342 | A | 5/1991 | Ginatta et al. | |
| 5,415,742 | A | 5/1995 | La Camera et al. | |
| 5,454,914 | A | 10/1995 | Gay | |
| 5,531,868 | A | 7/1996 | Miller et al. | |
| 5,582,706 | A | 12/1996 | Grantham et al. | |
| 5,689,538 | A | 11/1997 | Bonhomme | |
| 5,770,034 | A | 6/1998 | Jansen et al. | |
| 5,855,749 | A * | 1/1999 | Kohut et al. | 204/270 |
| 5,935,394 | A | 8/1999 | Sivilotti et al. | |
| 6,142,291 | A | 11/2000 | Schulze et al. | |
| 6,540,902 | B1 | 4/2003 | Redey et al. | |
| 6,689,260 | B1 | 2/2004 | Ahluwalia et al. | |
| 6,821,405 | B1 | 11/2004 | Marttila | |
| 6,866,768 | B2 | 3/2005 | Bradford et al. | |
| 7,011,736 | B1 | 3/2006 | Miller et al. | |
| 7,090,760 | B2 | 8/2006 | Seo et al. | |
| 7,097,747 | B1 | 8/2006 | Herceg et al. | |
| 7,449,635 | B2 | 11/2008 | Wiant | |
| 7,563,982 | B2 | 7/2009 | Kimmel | |
| 7,638,026 | B1 | 12/2009 | Willit et al. | |
| 7,799,185 | B1 | 9/2010 | Willit | |
| 8,248,760 | B2 * | 8/2012 | Abrahamsen et al. | 361/611 |
| 2004/0007466 | A1 | 1/2004 | Seo et al. | |
| 2004/0134785 | A1 | 7/2004 | Gay et al. | |
| 2004/0168932 | A1 | 9/2004 | Wang | |
| 2005/0067291 | A1 | 3/2005 | Haiki et al. | |
| 2005/0205428 | A1 | 9/2005 | Dees et al. | |
| 2005/0233634 | A1 | 10/2005 | Kollmann | |
| 2006/0067291 | A1 | 3/2006 | Nakata | |
| 2006/0096853 | A1 * | 5/2006 | King | 204/230.2 |
| 2007/0082551 | A1 | 4/2007 | Oesterhaus | |
| 2007/0295601 | A1 | 12/2007 | Bayer | |
| 2008/0128270 | A1 | 6/2008 | Hiraiwa et al. | |
| 2008/0142374 | A1 | 6/2008 | Iwama et al. | |
| 2008/0152270 | A1 | 6/2008 | Engesser et al. | |
| 2009/0050483 | A1 | 2/2009 | Li | |
| 2009/0152124 | A1 * | 6/2009 | Ashford et al. | 205/574 |
| 2010/0276259 | A1 | 11/2010 | Phalen | |
| 2011/0100328 | A1 * | 5/2011 | Paul | 123/445 |
| 2011/0180409 | A1 | 7/2011 | Willit et al. | |

FOREIGN PATENT DOCUMENTS

| | | | |
|---|---|---|---|
| DE | 26 00 344 | | 7/1977 |
| DE | 3837572 | | 5/1989 |
| DE | 19845258 | | 3/2000 |
| EP | 0 286 092 | | 10/1988 |
| EP | 0 736 929 | | 10/2009 |
| EP | 2224542 | | 9/2010 |
| GB | 284678 | | 11/1928 |
| GB | 284678 | A | 11/1928 |
| GB | 506590 | | 5/1939 |
| GB | 516775 | | 1/1940 |
| JP | H05279887 | | 10/1993 |
| JP | H0972991 | | 3/1997 |
| JP | 2006-308442 | | 11/2006 |
| WO | 02/066709 | A1 | 8/2002 |
| WO | 2004/187837 | A1 | 3/2004 |
| WO | WO 2004/031453 | | 4/2004 |
| WO | WO 2005/035404 | | 4/2005 |
| WO | 2006/007863 | A1 | 1/2006 |
| WO | 2009/062005 | A1 | 5/2009 |
| WO | WO 2010/080761 | | 7/2010 |

OTHER PUBLICATIONS

"Proceedings of GLOBAL 2005", Tsukuba, Japan, Oct. 9-13, 2005, Paper No. 488.

International Search Report dated Jan. 20, 2012 issued in PCT/US2011/053589.

International Search Report dated Jan. 30, 2012 issued in PCT/US2011/053878.

International Search Report dated Feb. 6, 2012 issued in PCT/US2011/053872.

International Search Report dated May 11, 2012 issued in PCT/US2011/053871.

International search report issued in connection with WO application No. PCT/US2012/058531, Aug. 2, 2013.

International Search Report and Written Opinion issued in International Patent Application No. PCT/US2012/058663, issued Aug. 12, 2013.

European Search Report issued in European Patent Application No. 13163951.0, issued Aug. 29, 2013.

"Electrolytic Reduction of Spent Oxide Fuel-Bench-Scale Test Results", Steven D. Herman, Shelly X. Li, Michael F. Simpson.

International Search Report and Written Opinion issued in International Patent Application No. PCT/US2012/058664, mailed Jul. 8, 2013.

International Search Report and Written Opinion issued in International Patent Application No. PCT/US2012/058659, mailed Jul. 5, 2013.

International Search Report and Written Opinion issued in International Patent Application No. PCT/US2012/058661, mailed Jul. 25, 2013.

Figueroa, J. et al., "GTRI Progress in Developing Pyrochemical Processes for Recovery of Fabrication Scrap and Reprocessing of Monolithic U-MO Fuel", RERTR 2011—International Meeting on Reduced Enrichment for Research and Test Reactors, Oct. 23, 2011, XP055071122.

Journeau, et al., "Physico-chemical analyses and solidification path reconstruction of multi-component oxidic spread melts." Materials Science and Engineering A. vol. 299. Feb. 15, 2001. pp. 249-266.

International Atomic Energy Agency (IAEA). "Storage and Disposal of Spent Fuel and High Level Radioactive Waste". Additional paper to the IAEA's Nuclear Technology Review (2006), pp. 1-11.

Morss, et al., "Cerium, uranium, and plutonium behavior in glass-bonded sodalite, a ceramic nuclear waste form." Journal of Alloys and Compounds. vols. 303-304. May 24, 2000. pp. 42-48.

Abraham, et al., "Metal waste forms from treatment of EBR—II spent fuel." Argonne National Laboratory. Presented at Spectrum '98 Conference. Sep. 18, 1998, pp. 1-7.

* cited by examiner

CATHODE POWER DISTRIBUTION SYSTEM AND METHOD OF USING THE SAME FOR POWER DISTRIBUTION

GOVERNMENT SUPPORT

This invention was made with Government support under contract number DE-AC02-06CH11357, awarded by the U.S. Department of Energy. The Government has certain rights in the invention.

BACKGROUND

An electrochemical process may be used to recover metals from an impure feed and/or to extract metals from a metal-oxide. A conventional process (for soluble metal oxides) typically involves dissolving a metal-oxide in an electrolyte followed by electrolytic decomposition or (for insoluble metal oxides) selective electrotransport to reduce the metal-oxide to its corresponding metal. Conventional electrochemical processes for reducing insoluble metal-oxides to their corresponding metallic state may employ a single step or multiple-step approach.

A multiple-step approach may be a two-step process that utilizes two separate vessels. For example, the extraction of uranium from the uranium oxide of spent nuclear fuels includes an initial step of reducing the uranium oxide with lithium dissolved in a molten LiCl electrolyte so as to produce uranium metal and $Li_2O$ in a first vessel, wherein the Li2O remains dissolved in the molten LiCl electrolyte. The process then involves a subsequent step of electrowinning in a second vessel, wherein the dissolved $Li_2O$ in the molten LiCl is electrolytically decomposed to form oxygen and regenerate lithium. Consequently, the resulting uranium metal may be extracted in an electrorefining process, while the molten LiCl with the regenerated lithium may be recycled for use in the reduction step of another batch.

However, a multi-step approach involves a number of engineering complexities, such as issues pertaining to the transfer of molten salt and reductant at high temperatures from one vessel to another. Furthermore, the reduction of oxides in molten salts may be thermodynamically constrained depending on the electrolyte-reductant system. In particular, this thermodynamic constraint will limit the amount of oxides that can be reduced in a given batch. As a result, more frequent transfers of molten electrolyte and reductant will be needed to meet production requirements.

On the other hand, a single-step approach generally involves immersing a metal oxide in a compatible molten electrolyte together with a cathode and anode. By charging the anode and cathode, the metal oxide (which is in electrical contact with the cathode) can be reduced to its corresponding metal through electrolytic conversion and ion exchange through the molten electrolyte. However, although a conventional single-step approach may be less complex than a multi-step approach, the yield of the metallic product is relatively low. Furthermore, the metallic product still contains unwanted impurities.

SUMMARY

Embodiments include a cathode power distribution system and/or method of using the same for power distribution.

The cathode power distribution system includes a plurality of cathode assemblies. Each cathode assembly of the plurality of cathode assemblies includes a plurality of cathode rods. The system also includes a plurality of bus bars configured to distribute current to each of the plurality of cathode assemblies. The plurality of bus bars include a first bus bar configured to distribute the current to first ends of the plurality of cathode assemblies and a second bus bar configured to distribute the current to second ends of the plurality of cathode assemblies.

The plurality of cathode rods may extend into molten salt electrolyte of an electrorefiner. In one embodiment, the plurality of cathode rods have a same orientation and are arranged so as to be within the same plane. Also, the first and second bus bars are arranged to be perpendicular to the same plane of the plurality of cathode rods, and the first bus bar is parallel with the second bus bar.

The cathode power distribution system may further include a plurality of cathode power feedthrough units configured to supply the current to the first and second bus bars. In one embodiment, the plurality of cathode power feedthrough units include a first cathode power feedthrough unit connected to a first end of the first bus bar and a second cathode power feedthrough unit connected to a second end of the second bus bar. The second end is opposite to the first end.

The first and second cathode power feedthrough units supply the current to the first bus bar and the second bus bar, respectively. The plurality of cathode assemblies are arranged such that a cathode assembly flanks both sides of an anode assembly. In one embodiment, each of the plurality of cathode assemblies includes an assembly header bus, and the plurality of cathode rods are connected to the assembly header bus.

The cathode power distribution system may further include a manifold configured to transfer cooling gas such that a temperature of the plurality of cathode assemblies is decreased. In one embodiment, the manifold is arranged outside an area encompassing the plurality of cathode assemblies. In one embodiment, the manifold is connected to the plurality of cathode assemblies via a plurality of tubes. Each cathode assembly may be connected to the manifold via two tubes of the plurality of tubes. The manifold may include a plurality of pipes and one of the plurality of pipes includes an intake opening configured to receive the cooling gas.

The method includes distributing current to each of a plurality of cathode assemblies. Each cathode assembly includes a plurality of cathode rods. The distributing step distributes the current to each of the plurality of cathode assemblies via a plurality of bus bars. The plurality of bus bars includes a first bus bar that distributes the current to first ends of the plurality of cathode assemblies and a second bus bar that distributes the current to second ends of the plurality of cathode assemblies.

The method further includes supplying, by a plurality of cathode power feedthrough units, the current to the first and second bus bars. In one embodiment, the supplying step further includes supplying the current to a first end of the first bus bar and supplying the current to a second end of the second bus bar. The second end is opposite to the first end. The method may further include transferring, by a manifold, cooling gas such that a temperature of the plurality of cathode assemblies is deceased.

DETAILED DESCRIPTION

Figure 1:
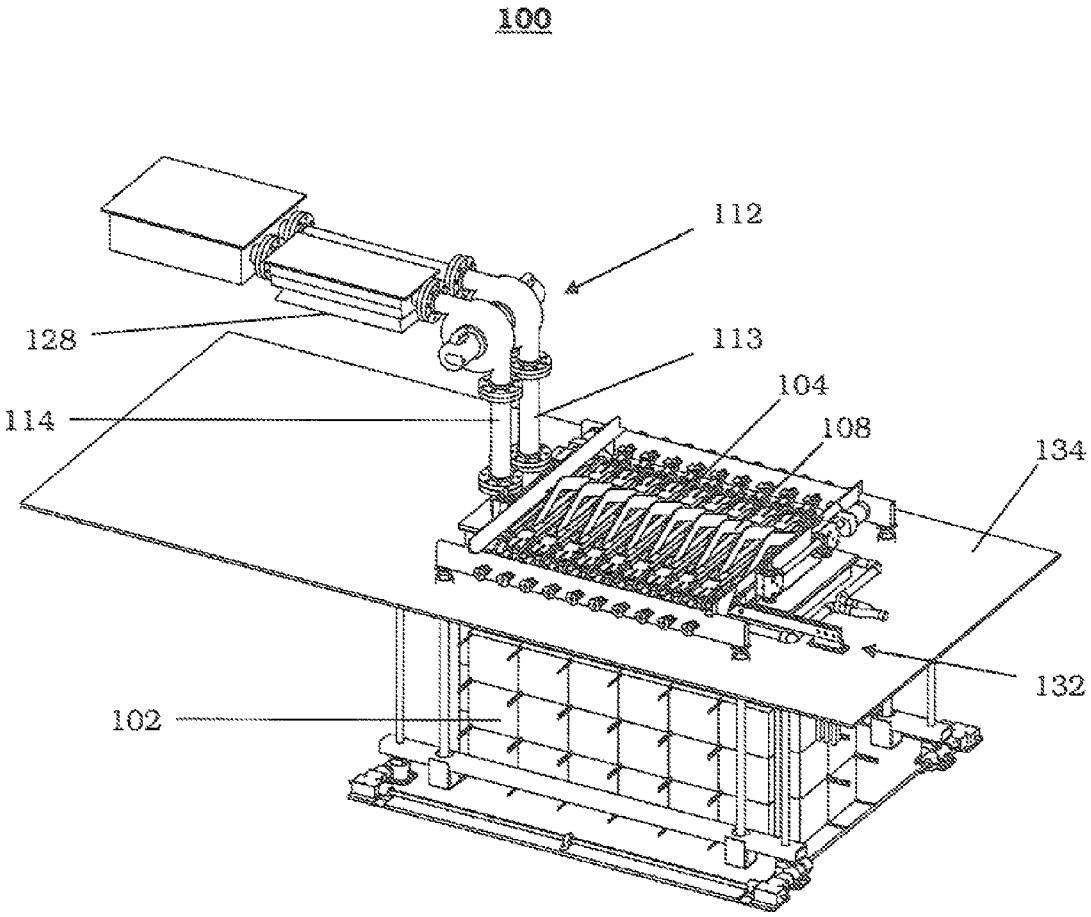
FIG. 1 is a perspective view of an electrorefiner system including a cathode power distribution system according to an example embodiment.

Hereinafter, example embodiments will be described in detail with reference to the attached drawings. However, specific structural and functional details disclosed herein are merely representative for purposes of describing example embodiments. The example embodiments may be embodied in many alternate forms and should not be construed as limited to only example embodiments set forth herein.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of example embodiments. As used herein, the term "and/or" includes any and all combinations of one or more of the associated listed items.

It will be understood that when an element is referred to as being "connected," "coupled," "mated," "attached," or "fixed" to another element, it can be directly connected or coupled to the other element or intervening elements may be present. In contrast, when an element is referred to as being "directly connected" or "directly coupled" to another element, there are no intervening elements present. Other words used to describe the relationship between elements should be interpreted in a like fashion (e.g., "between" versus "directly between", "adjacent" versus "directly adjacent", etc.).

As used herein, the singular forms "a", "an" and "the" are intended to include the plural forms as well, unless the language explicitly indicates otherwise. It will be further understood that the terms "comprises", "comprising,", "includes" and/or "including", when used herein, specify the presence of stated features, integers, steps, operations, elements, and/or components, but do not preclude the presence or addition of one or more other features, integers, steps, operations, elements, components, and/or groups thereof.

It should also be noted that in some alternative implementations, the functions/acts noted may occur out of the order noted in the figures or described in the specification. For example, two figures or steps shown in succession may in fact be executed in series and concurrently or may sometimes be executed in the reverse order or repetitively, depending upon the functionality/acts involved.

An electrorefiner system according to a non-limiting embodiment may be used to recover a purified metal (e.g., uranium) from a relatively impure nuclear feed material (e.g., impure uranium feed material). The electrorefiner system may be as described in U.S. application Ser. No. 13/335,082, filed on even date herewith, titled "ELECTROREFINER SYSTEM FOR RECOVERING PURIFIED METAL FROM IMPURE NUCLEAR FEED MATERIAL," the entire contents of which are incorporated herein by reference. The impure nuclear feed material may be a metallic product of an electrolytic oxide reduction system. The electrolytic oxide reduction system may be configured to facilitate the reduction of an oxide to its metallic form so as to permit the subsequent recovery of the metal. The electrolytic oxide reduction system may be as described in U.S. application Ser. No. 12/978,027, filed Dec. 23, 2010, "ELECTROLYTIC OXIDE REDUCTION SYSTEM," the entire contents of which is incorporated herein by reference.

Generally, the electrorefiner system may include a vessel, a plurality of cathode assemblies, a plurality of anode assemblies, a power system, a scraper, and/or a conveyor system. The power system for the electrorefiner system may include a common bus bar for the plurality of cathode assemblies, which is further explained below with reference to FIG. 3. Power may be supplied to the common bus bar through a floor structure via an electrical feedthrough unit. In addition to the disclosure herein, the electrical feedthrough unit may be as described in U.S. application Ser. No. 13/335,139, filed on even date herewith, titled "BUS BAR ELECTRICAL FEEDTHROUGH FOR ELECTROREFINER SYSTEM," the entire contents of which are incorporated herein by reference.

The scraper may be as described in U.S. application Ser. No. 13/335,209, filed on even date herewith, titled "CATHODE SCRAPER SYSTEM AND METHOD OF USING THE SAME FOR REMOVING URANIUM," the entire contents of which are incorporated herein by reference. The conveyor system may be as described in U.S. application Ser. No. 13/335,140, filed on even date herewith, titled "CONTINUOUS RECOVERY SYSTEM FOR ELECTROREFINER SYSTEM," the entire contents of which are incorporated herein by reference. However, it should be understood that the electrorefiner system is not limited thereto and may include other components that may not have been specifically identified herein. Furthermore, the electrorefiner system and/or electrolytic oxide reduction system may be used to perform a method for corium and used nuclear fuel stabilization processing. The method may be as described in U.S. application Ser. No. 13/453,290, filed on Apr. 23, 2012, titled "METHOD FOR CORIUM AND USED NUCLEAR FUEL STABILIZATION PROCESSING," the entire contents of which are incorporated herein by reference.

As noted above, the impure nuclear feed material for the electrorefiner system may be a metallic product of an electrolytic oxide reduction system. During the operation of an electrolytic oxide reduction system, a plurality of anode and cathode assemblies are immersed in a molten salt electrolyte. In a non-limiting embodiment of the electrolytic oxide reduction system, the molten salt electrolyte may be lithium chloride (LiCl). The molten salt electrolyte may be maintained at a temperature of about 650° C. (+50° C., −30° C.). An electrochemical process is carried out such that a reducing potential is generated at the cathode assemblies, which contain the oxide feed material (e.g., metal oxide). Under the influence of the reducing potential, the metal ion of the metal oxide is reduced to metal and the oxygen (O) from the metal oxide (MO) feed material dissolves into the molten salt electrolyte as an oxide ion, thereby leaving the metal (M) behind in the cathode assemblies. The cathode reaction may be as follows:

$$MO+2e^{-}\rightarrow M+O^{2-}$$

At the anode assemblies, the oxide ion is converted to oxygen gas. The anode shroud of each of the anode assemblies may be used to dilute, cool, and remove the oxygen gas from the electrolytic oxide reduction system during the process. The anode reaction may be as follows:

$$O^{2-}\rightarrow \tfrac{1}{2}O_2+2e^{-}$$

The metal oxide may be uranium dioxide (UO2), and the reduction product may be uranium metal. However, it should be understood that other types of oxides may also be reduced to their corresponding metals with the electrolytic oxide reduction system. Similarly, the molten salt electrolyte used in the electrolytic oxide reduction system is not particularly limited thereto and may vary depending of the oxide feed material to be reduced.

After the electrolytic oxide reduction, the basket containing the metallic product in the electrolytic oxide reduction system is transferred to the electrorefiner system according to the example embodiments for further processing to obtain a purified metal from the metallic product. Stated more clearly, the metallic product from the electrolytic oxide reduction system will serve as the impure nuclear feed material for the electrorefiner system according to the example embodiments. Notably, while the basket containing the metallic product is a cathode assembly in the electrolytic oxide reduction system, the basket containing the metallic product is an anode assembly in the electrorefiner system. Compared to prior art apparatuses, the electrorefiner system according to the example embodiments allows for a significantly greater yield of purified metal.

Figure 2:
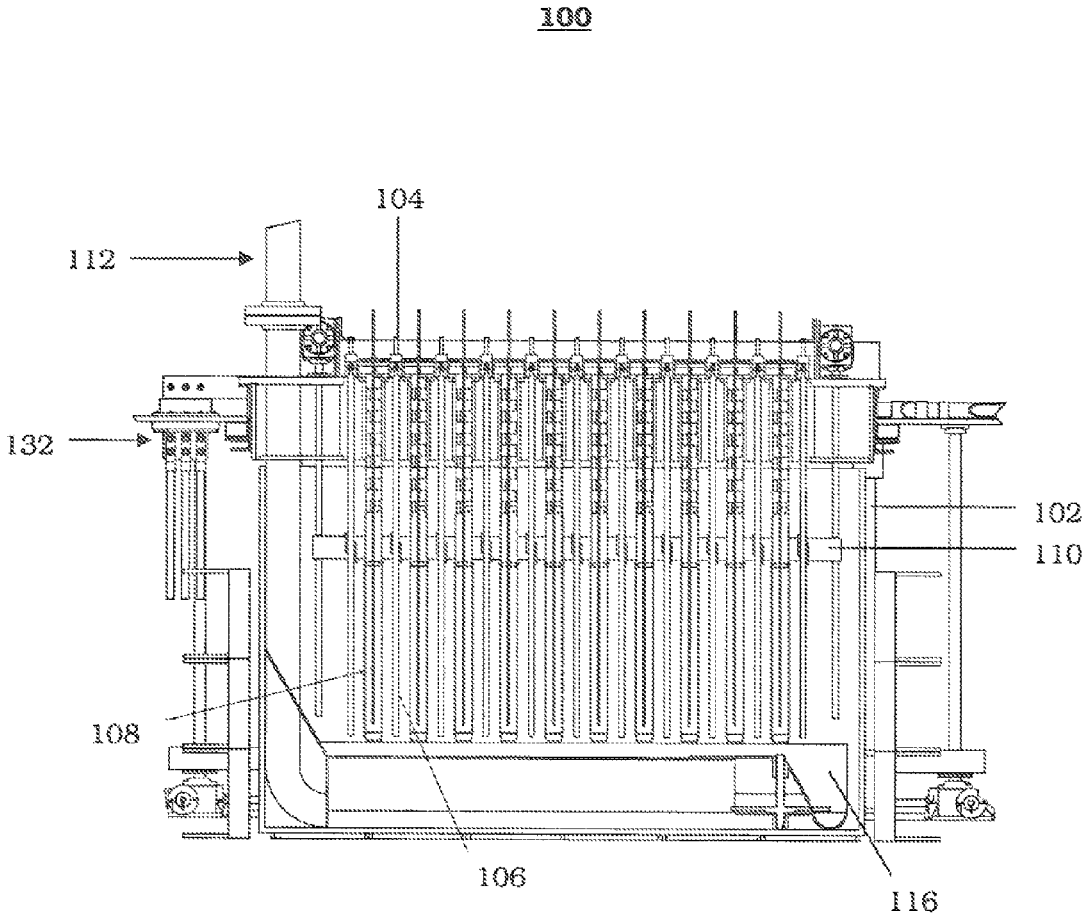
FIG. 2 is a cross-sectional side view of an electrorefiner system including a cathode power distribution system according to an example embodiment.

FIG. 1 is a perspective view of an electrorefiner system including a cathode power distribution system according to a non-limiting embodiment of the example embodiments. FIG. 2 is a cross-sectional side view of an electrorefiner system including a cathode power distribution system according to a non-limiting embodiment of the example embodiments.

Referring to FIGS. 1-2, the electrorefiner system 100 includes a vessel 102, a plurality of cathode assemblies 104, a plurality of anode assemblies 108, a power system, a scraper 110, and/or a conveyor system 112. Each of the plurality of cathode assemblies 104 may include a plurality of cathode rods 106. The power system may include an electrical feedthrough unit 132 that extends through the floor structure 134. The floor structure 134 may be a glovebox floor in a glovebox. Alternatively, the floor structure 134 may be a support plate in a hot-cell facility. The conveyor system 112 may include an inlet pipe 113, a trough 116, a chain, a plurality of flights, an exit pipe 114, and/or a discharge chute 128.

The vessel 102 is configured to maintain a molten salt electrolyte. In a non-limiting embodiment, the molten salt electrolyte may be LiCl, a LiCl—KCl eutectic, or another suitable medium. The vessel 102 may be situated such that a majority of the vessel 102 is below the floor structure 134. For instance, an upper portion of the vessel 102 may extend above the floor structure 134 through an opening in the floor structure 134. The opening in the floor structure 134 may correspond to the dimensions of the vessel 102. The vessel 102 is configured to receive the plurality of cathode assemblies 104 and the plurality of anode assemblies 108.

The plurality of cathode assemblies 104 are configured to extend into the vessel 102 so as to at least be partially submerged in the molten salt electrolyte. For instance, the dimensions of the plurality of cathode assemblies 104 and/or the vessel 102 may be adjusted such that the majority of the length of the plurality of cathode assemblies 104 is submerged in the molten salt electrolyte in the vessel 102. Each cathode assembly 104 may include a plurality of cathode rods 106 having the same orientation and arranged so as to be within the same plane.

The plurality of anode assemblies 108 may be alternately arranged with the plurality of cathode assemblies 104 such that each anode assembly 108 is flanked by two cathode assemblies 104. The plurality of cathode assemblies 104 and anode assemblies 108 may be arranged in parallel. Each anode assembly 108 may be configured to hold and immerse an impure uranium feed material in the molten salt electrolyte maintained by the vessel 102. The dimensions of the plurality of anode assemblies 108 and/or the vessel 102 may be adjusted such that the majority of the length of the plurality of anode assemblies 108 is submerged in the molten salt electrolyte in the vessel 102. Although the electrorefiner system 100 is illustrated in FIGS. 1-2 as having eleven cathode assemblies 104 and ten anode assemblies 108, it should be understood that the example embodiments herein are not limited thereto.

In the electrorefiner system 100, a cathode power distribution system is connected to the plurality of cathode assemblies 104 and anode assemblies 108. The cathode power distribution system is further described with reference to FIG. 3.

To initiate the removal of the purified uranium, the scraper 110 is configured to move up and down along the length of the plurality of cathode rods 106 to dislodge the purified uranium deposited on the plurality of cathode rods 106 of the plurality of cathode assemblies 104. As a result of the scraping, the dislodged purified uranium sinks through the molten salt electrolyte to the bottom of the vessel 102.

The conveyor system 112 is configured such that at least a portion of it is disposed at the bottom of the vessel 102. For example, the trough 116 of the conveyor system 112 may be disposed at the bottom of the vessel 102 such that the purified uranium dislodged from the plurality of cathode rods 106 accumulates in the trough 116. The conveyor system 112 is configured to transport the purified uranium accumulated in the trough 116 through an exit pipe 114 to a discharge chute 128 so as to remove the purified uranium from the vessel 102.

Figure 3:
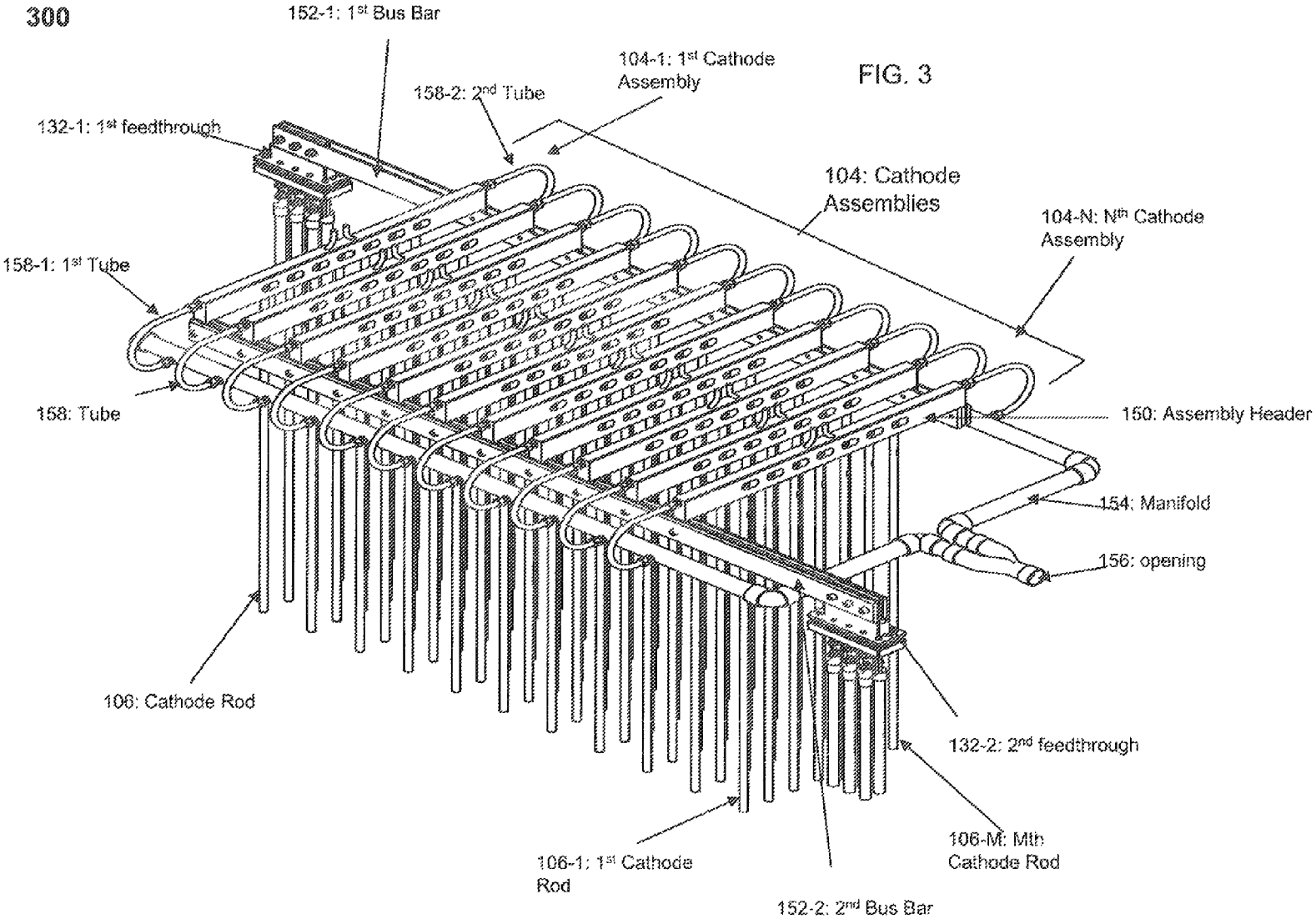
FIG. 3 illustrates a cathode power distribution system according to an example embodiment.

FIG. 3 illustrates a cathode power distribution system according to an example embodiment. The cathode power distribution system is illustrated with components from and as useable with the electrorefining system 100 (FIGS. 1-2); however, it is understood that example embodiments are useable in other electrorefining systems.

As shown in FIG. 3, the cathode power distribution system includes the plurality of cathode assemblies 104. The plurality of cathode assemblies 104 may be the plurality of cathode assemblies of FIGS. 1-2. Each cathode assembly 104 is the same or similar in configuration, and may be easily removed from the refining cell without the use of special tools. The plurality of cathode assemblies 104 includes a first cathode assembly 104-1 to $N^{th}$ cathode assembly 104-N, where a value of N is any integer greater or equal to two. As explained above, the plurality of cathode assemblies 104 may be interleaved with the anode assemblies 108. In other words, the cathode assemblies 104 are arranged such that a cathode assemblies 104 flanks both sides of an anode assembly 108. Each cathode assembly 104 includes the plurality of cathode rods 106. The plurality of cathode rods 106 include a first cathode rod 106-1 to $M^{th}$ cathode rod 106-M, where a value of M is any integer greater or equal to two. As described above, the plurality of cathode rods 106 extend into the molten salt electrolyte of the vessel 102 of the electrorefiner system 100.

For each cathode assembly 104, the cathode rods 106 may have the same orientation and are arranged so as to be within the same plane. Each cathode assembly 104 includes an assembly header bus 150. The cathode rods 106 are connected to the assembly header bus 150.

The cathode power distribution system includes a plurality of bus bars 152 that are configured to distribute current to each of the plurality of cathode assemblies 104. The bus bars 152 include a first bus bar 152-1 configured to distribute the current to first ends of the cathode assemblies 104 and a second bus bar 152-2 configured to distribute the current to second ends of the cathode assemblies 104. The first bus bar 152-1 may be parallel with the second bus bar 152-2. Also, the first bus bar 152-1 and the second bus bar 152-2 are arranged to be perpendicular to the same plane of the cathode rods 106. The first bus bar 152-1 may be connected to ends of the assembly header bus 150 of each cathode assembly 104. The second bus bar 152-2 may be connected to the other ends of the assembly header bus 150 of each cathode assembly 104.

The cathode power distribution system includes a plurality of cathode power feedthrough units 132 that are configured to supply the current to the bus bars 152. As indicated above, the cathode power feedthrough units may be as described in U.S. application Ser. No. 13/335,139.

The bus bars 152 are configured to evenly distribute the current to each of the cathode assemblies 104. The cathode power feedthrough units 132 include a first cathode power feedthrough unit 132-1 and a second cathode power feedthrough unit 132-2. The first cathode power feedthrough unit 132-1 is connected to a first end of the first bus bar 152-1, and the second cathode power feedthrough unit 132-2 is connected to a second end of the second bus bar 152-2, where the second end is opposite to the first end. Also, the first cathode power feedthrough unit 132-1 and the second cathode power feedthrough unit 132-2 are connected to an external power system located outside the glovebox. The external power system may be any type of power system that generates and/or delivers current. As such, the first cathode power feedthrough 132-1 and the second power feedthrough unit 132-2 supply the current to the first bus bar 152-1 and the second bus bar 152-2, respectively.

The cathode power distribution system includes a manifold 154 configured to transfer cooling gas such that a temperature of the cathode assemblies 104 is decreased. For example, the manifold 154 may be arranged outside an area encompassing the cathode assemblies 104. The manifold 154 may comprise a plurality of pipes with an intake opening 156. The intake opening 156 is configured to receive the cooling gas, where the cooling gas is transferred via the pipes. The manifold 154 is connected to the cathode assemblies 104 via a plurality of tubes 158. For example, each cathode assembly 104 is connected to the manifold 154 via a first tube 158-1 and a second tube 158-2. One end of the first tube 158-1 is connected to the assembly header bus 150 of each cathode assembly 104 and the other end of the first tube 158-1 is connected to the manifold 154. One end of the second tube 158-2 is connected to the assembly header bus 150 of each cathode assembly 104 and the other end of the second tube 158-2 is connected to the manifold 154. The cooling gas is vented from the assembly header 150 into the glovebox or similar enclosure. The gas is then cooled and purified by the glovebox (or similar enclosure) atmosphere control system prior to recycle.

A desired power level, measured in either current or voltage, is applied to cathode assemblies 104 via the cathode power distribution system so as to charge the plurality of cathode rods 106. This charging, while the anode assemblies 108 are contacted with an electrolyte, oxidizes the impure uranium metal contained in the anode assemblies to form uranium ions that are soluble in the molten salt. The uranium ions transport to the cathode rods 106, in contact with the same electrolyte, where they are reduced to form purified uranium metal. Example methods may further swap modular parts of assemblies or entire assemblies within the electrorefining system based on repair or system configuration needs, providing a flexible system that can produce variable amounts of purified metal and/or be operated at desired power levels, electrolyte temperatures, and/or any other system parameter based on modular configuration. Following purification, the purified metal may be removed and used in a variety of chemical processes based on the identity of the purified metal. For example, reduced and purified uranium metal may be reprocessed into nuclear fuel.

Example embodiments thus being described, it will be appreciated by one skilled in the art that example embodiments may be varied through routine experimentation and without further inventive activity. For example, although electrical contacts are illustrated in example embodiments at one side of an example reducing system, it is of course understood that other numbers and configurations of electrical contacts may be used based on expected cathode and anode assembly placement, power level, necessary anodizing potential, etc. Variations are not to be regarded as departure from the spirit and scope of the example embodiments, and all such modifications as would be obvious to one skilled in the art are intended to be included within the scope of the following claims.

What is claimed is:

1. A cathode power distribution system, comprising:

a plurality of cathode assemblies, each cathode assembly of the plurality of cathode assemblies including a plurality of cathode rods;

a plurality of bus bars configured to distribute current to each of the plurality of cathode assemblies, the plurality of bus bars including a first bus bar configured to distribute the current to first ends of the plurality of cathode assemblies and a second bus bar configured to distribute the current to second ends of the plurality of cathode assemblies; and a manifold configured to transfer cooling gas to decrease a temperature of the plurality of cathode assemblies, the manifold connected to the plurality of cathode assemblies via a plurality of tubes.

2. The cathode power distribution system of claim 1, wherein the plurality of cathode rods is configured to extend into a molten salt electrolyte of an electrorefiner.

3. The cathode power distribution system of claim 1, wherein the plurality of cathode rods have a same orientation and are arranged so as to be within a same plane.

4. The cathode power distribution system of claim 3, wherein the first and second bus bars are arranged to be perpendicular to the same plane of the plurality of cathode rods, and the first bus bar is parallel with the second bus bar.

5. The cathode power distribution system of claim 1, further comprising:

a plurality of cathode power feedthrough units configured to supply the current to the first and second bus bars.

6. The cathode power distribution system of claim 5, wherein the plurality of cathode power feedthrough units include:

a first cathode power feedthrough unit connected to a first end of the first bus bar; and a second cathode power feedthrough unit connected to a second end of the second bus bar, the second end being opposite to the first end.

7. The cathode power distribution system of claim 6, wherein the first and second cathode power feedthrough units are configured to supply the current to the first bus bar and the second bus bar, respectively.

8. The cathode power distribution system of claim 1, wherein the plurality of cathode assemblies are arranged such that a cathode assembly flanks both sides of an anode assembly.

9. The cathode power distribution system of claim 1, wherein each of the plurality of cathode assemblies includes an assembly header bus, and the plurality of cathode rods are connected to the assembly header bus.

10. The cathode power distribution system of claim 1, wherein the manifold is arranged outside an area encompassing the plurality of cathode assemblies.

11. The cathode power distribution system of claim 1, wherein each cathode assembly is connected to the manifold via two tubes of the plurality of tubes.

12. The cathode power distribution system of claim 1, wherein the manifold includes a plurality of pipes and one of the plurality of pipes includes an intake opening configured to receive the cooling gas.

13. A method for distributing current in a cathode power distribution system:

distributing current to each of a plurality of cathode assemblies via a plurality of bus bars, each cathode assembly including a plurality of cathode rods, the plurality of bus bars including a first bus bar that distributes the current to first ends of the plurality of cathode assemblies and a second bus bar that distributes the current to second ends of the plurality of cathode assemblies; and transferring, by a manifold, cooling gas to decrease a temperature of the plurality of cathode assemblies, the manifold connected to the plurality of cathode assemblies via a plurality of tubes.

14. The method of claim 13, further comprising:

supplying, by a plurality of cathode power feedthrough units, the current to the first and second bus bars.

15. The method of claim 13, wherein the supplying step further includes:

supplying, by a first cathode power feedthrough unit, the current to a first end of the first bus bar; and supplying, by a second cathode power feedthrough unit, the current to a second end of the second bus bar, the second end being opposite to the first end.

* * * * *